US005368967A

United States Patent [19]

Schank et al.

[11] Patent Number: 5,368,967

[45] Date of Patent: Nov. 29, 1994

[54] LAYERED PHOTORECEPTOR WITH OVERCOAT CONTAINING HYDROGEN BONDED MATERIALS

[75] Inventors: Richard L. Schank, Pittsford; Damodar M. Pai, Fairport; John F. Yanus; Dale S. Renfer, both of Webster; Paul J. DeFeo, Sodus Point; William W. Limburg, Penfield, all of N.Y.

[73] Assignee: Xerox Corporation, Stamford, Conn.

[21] Appl. No.: 172,520

[22] Filed: Dec. 21, 1993

[51] Int. Cl.[5] ..... G03G 5/047; G03G 5/147

[52] U.S. Cl. ..... 430/59; 430/66

[58] Field of Search ..... 430/59, 66

[56] References Cited

U.S. PATENT DOCUMENTS

| | | | |
|---|---|---|---|
| 4,050,935 | 9/1977 | Limburg et al. | 430/59 |
| 4,281,054 | 7/1981 | Horgan et al. | 430/59 |
| 4,297,425 | 10/1981 | Pai et al. | 430/58 |
| 4,457,994 | 7/1984 | Pai et al. | 430/59 |
| 4,515,882 | 5/1985 | Mammino et al. | 430/58 |
| 4,599,286 | 7/1986 | Limburg et al. | 430/59 |
| 4,871,634 | 10/1989 | Limburg et al. | 430/54 |
| 4,999,268 | 3/1991 | Ojima et al. | 430/59 |

*Primary Examiner*—Roland Martin

[57] ABSTRACT

An electrophotographic imaging member comprising a substrate, a charge generating layer, a charge transport layer, and an overcoat layer comprising a small molecule hole transporting arylamine having at least two hydroxy functional groups, a hydroxy or multihydroxy triphenyl methane and a polyamide film forming binder capable of forming hydrogen bonds with the hydroxy functional groups the hydroxy arylamine and hydroxy or multihydroxy triphenyl methane. This overcoat layer may be fabricated using an alcohol solvent. This electrophotographic imaging member may be utilized in an electrophotographic imaging process.

16 Claims, 8 Drawing Sheets

$$-(C=C)_n-C=C- \quad \text{where } n=0 \text{ or } 1$$
FIG. 4
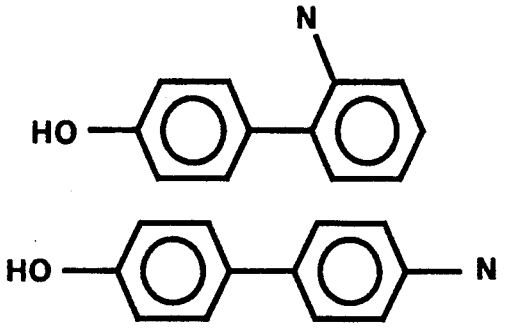
FIG. 5
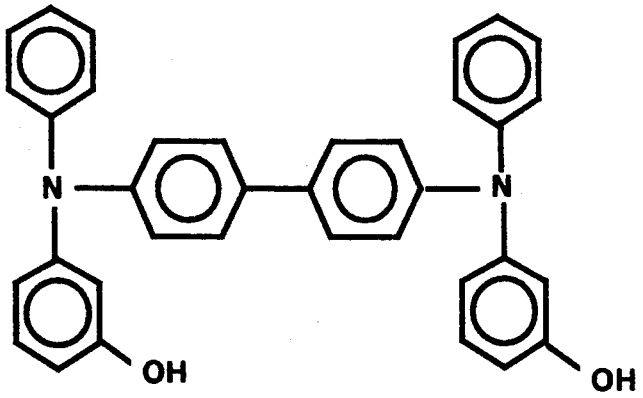
FIG. 6
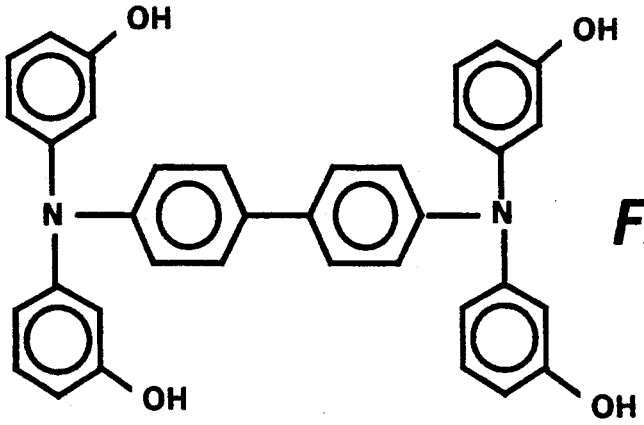
FIG. 7

LAYERED PHOTORECEPTOR WITH OVERCOAT CONTAINING HYDROGEN BONDED MATERIALS

BACKGROUND OF THE INVENTION

This invention relates in general to electrophotographic imaging members and, more specifically, to layered photoreceptor structures with overcoatings containing hydrogen bonded materials and processes for making and using the photoreceptors.

Electrophotographic imaging members, i.e. photoreceptors, typically include a photoconductive layer formed on an electrically conductive substrate. The photoconductive layer is an insulator in the dark so that electric charges are retained on its surface. Upon exposure to light, the charge is dissipated.

A latent image is formed on the photoreceptor by first uniformly depositing an electric charge over the surface of the photoconductive layer by one of any suitable means well known in the art. The photoconductive layer functions as a charge storage capacitor with charge on its free surface and an equal charge of opposite polarity (the counter charge) on the conductive substrate. A light image is then projected onto the photoconductive layer. On those portions of the photoconductive layer that are exposed to light, the electric charge is conducted through the layer reducing the surface charge. The portions of the surface of the photoconductor not exposed to light retain their surface charge. The quantity of electric charge at any particular area of the photoconductive surface is inversely related to the illumination incident thereon, thus forming an electrostatic latent image.

The photodischarge of the photoconductive layer requires that the layer photogenerate conductive charge and transport this charge through the layer thereby neutralizing the charge on the surface. Two types of photoreceptor structures have been employed: multilayer structures wherein separate layers perform the functions of charge generation and charge transport, respectively, and single layer photoconductors which perform both functions. These layers are formed on an electrically conductive substrate and may include an optional charge blocking and an adhesive layer between the conductive layer and the photoconducting layer or layers. Additionally, the substrate may comprise a non-conducting mechanical support with a conductive surface. Other layers for providing special functions such as incoherent reflection of laser light, dot patterns for pictorial imaging or subbing layers to provide chemical sealing and/or a smooth coating surface may be optionally be employed.

One common type of photoreceptor is a multilayered device that comprises a conductive layer, a blocking layer, an adhesive layer, a charge generating layer, and a charge transport layer. The charge transport layer can contain an active aromatic diamine molecule, which enables charge transport, dissolved or molecularly dispersed in a film forming binder. This type of charge transport layer is described, for example in U.S. Pat. No. 4,265,990. The disclosures of this patent is incorporated herein in its entirety. Other charge transport molecules disclosed in the prior art include a variety of electron donor, aromatic amines, oxadiazoles, oxazoles, hydrazones and stilbenes for hole transport and electron acceptor molecules for electron transport. Another type of charge transport layer has been developed which utilizes a charge transporting polymer wherein the charge transporting moiety is incorporated in the polymer as a group pendant from the backbone of the polymer backbone or as a moiety in the backbone of the polymer. These types of charge transport polymers include materials such as poly(N-vinylcarbazole), polysilylenes, and others including those described, for example, in U.S. Pat. Nos. 4,618,551, 4,806,443, 4,806,444, 4,818,650, 4,935,487, and 4,956,440. The disclosures of these patents are incorporated herein in their entirety.

One of the design criteria for the selection of the photosensitive pigment for a charge generator layer and the charge transporting molecule for a transport layer is that, when light photons photogenerate holes in the pigment, the holes be efficiently injected into the charge transporting molecule in the transport layer. More specifically, the injection efficiency from the pigment to the transport layer should be high. A second design criterion is that the injected holes be transported across the charge transport layer in a short time; shorter than the time duration between the exposure and development stations in an imaging device. The transit time across the transport layer is determined by the charge carrier mobility in the transport layer. The charge carrier mobility is the velocity per unit field and has dimensions of cm2/volt sec. The charge carrier mobility is a function of the structure of the charge transporting moiety, the concentration of the charge transporting moiety in the transport layer and the electrically "inactive" binder polymer in which the charge transport molecule is dispersed (if the transport layer consists of charge transporting molecules dispersed in a binder). It is believed that the injection efficiency can be maximized by choosing a transporting moiety whose ionization potential is lower than that of the pigment (assuming the charge transporting carriers are holes). However, low ionization potential molecules may have other deficiencies, one of which is their instability in an atmosphere of corona effluents. A copy quality defect resulting from the chemical interaction of the surface of the transport layer with corona effluents is referred to as "parking deletion" and is described in detail below.

Photoreceptors are cycled many thousands of times in automatic copiers, duplicators and printers. This cycling causes degradation of the imaging properties of photoreceptors, particularly multilayered organic photoconductors which utilize organic film forming polymers and small molecule low ionization donor material in the charge transport layers. Such wear is accelerated when the photoreceptor is utilized in systems employing abrasive development systems such as single component development systems. Wear is an even greater problem where a drum is utilized which has such a small diameter that it must rotate many, many times merely to form images for each conventional size 8.5 inch by 11 inch document. Wear of the photoreceptor can be compensated by increasing the thickness of the charge transport layer. However, large increases in thickness of the charge transport layer can render the photoreceptor inoperable at high imaging process speeds because of the very long transit times of common charge transport layer materials. Also, large decreases in thickness due to wear can cause dramatic changes in electrical characteristics in only a few thousand cycles that cannot be readily compensated by even sophisticated computerized control apparatus.

When the electrophotographic imaging member is utilized in liquid ink development systems, leaching of small molecules from the charge transport layer into the liquid development can occur. Loss of the small molecule material due to leaching causes undesirable deterioration in electrical properties of the photoreceptor. Also, undesirable crystallization of the small molecule in the charge transport layer can adversely affect the electrical imaging characteristics of the photoreceptor.

Reprographic machines utilizing multilayered organic photoconductors also employ corotrons or scorotrons to charge the photoconductors prior to imagewise exposure. During the operating lifetime of these photoconductors they are subjected to corona effluents which include ozone, various oxides of nitrogen, etc. It is believed that some of these oxides of nitrogen are converted to nitric acid in the presence of water molecules present in the ambient operating atmosphere. The top surface of the photoconductor is exposed to the nitric acid during operation of the machine and charge transport moieties at the very top surface of the transport layer are converted to what is believed to be the nitrated species of the molecules. It is believed that the chemical transition state species could form an electrically conductive film. However, during operation of the machine, the cleaning subsystem continuously removes (by wear) a region of the top surface thereby preventing accumulation of the conductive species. Unfortunately, such is not the case when the machine is not operating (i.e. in idle mode) between two large copy runs. During the idle mode between long copy runs, a specific segment of the photoreceptor comes to rest (is parked) beneath a corotron that had been in operation during the long copy run. Although the high voltage to the corotron is turned off during the time period when the photoreceptor is parked, some effluents (e.g. nitric acid, etc.) continue to be emitted from the corotron shield, corotron housing, etc. This effluent emission is concentrated in the region of the stationary photoreceptor parked directly underneath the corotron. The effluents render that surface region electrically conductive. When machine operation is resumed for the next copy run, image spreading and loss of resolution occurs in the region of the photoconductor where surface conductivity was increased. Deletion may also be observed in the loss of fine lines and details in the final print. Thus, the corona induced changes primarily occur at the surface region of the charge transport layer. These changes are manifested in the form of increased conductivity which results in loss of resolution of the final toner images. In the case of severe increases in conductivity, there can be regions of severe deletions in the images. This problem is particularly severe in devices employing arylamine charge transport molecules such as N,N'-diphenyl-N,N'-bis(3-methylphenyl)-(1,1'-biphenyl)-4,4'-diamine and charge transport polymers incorporating diamine transporting moiety.

Although, "parking deletion" is described above, in some cases deletion might occur in all portions of the photoconductor. This will depend on the number and type of corotrons employed, the design of the photoconductor cavity and air-flow patterns around the photoconductor.

Thus, although the charge transport moiety or species meets most other electrophotographic criteria such as being devoid of traps, having high injection efficiency from many pigments, ease in synthesizing, and inexpensive, it encounters serious parking and other deletion problems when an idle mode is interposed between extended cycling runs.

INFORMATION DISCLOSURE STATEMENT

U.S. Pat. No. 4,871,634 to Limburg et al., issued Oct. 3, 1989 — An electrostatographic imaging member is disclosed which contains at least one electrophotoconductive layer, the imaging member comprising a photogenerating material and a hydroxy arylamine compound represented by a certain formula. The hydroxy arylamine compound can be used in an overcoating with the hydroxy arylamine compound bonded to a resin capable of hydrogen bonding such as a polyamide possessing alcohol solubility.

U.S. Pat. No. 4,297,425 to Pai et al., issued Oct. 27, 1981 — A layered photosensitive member is disclosed comprising a generator layer and a transport layer containing a combination of diamine and triphenyl methane molecules dispersed in a polymeric binder.

U.S. Pat. No. 4,050,935 to Limburg et al., issued Sep. 27, 1977 — A layered photosensitive member is disclosed comprising a generator layer of trigonal selenium and a transport layer of bis(4-diethylamino-2methylphenyl)phenylmethane molecularly dispersed in a polymeric binder.

U.S. Pat. No. 4,457,994 to Pai et al. et al, issued Jul. 3 1984 — A layered photosensitive member is disclosed comprising a generator layer and a transport layer containing a diamine type molecule dispersed in a polymeric binder and an overcoat containing triphenyl methane molecules dispersed in a polymeric binder.

U.S. Pat. No. 4,281,054 to Horgan et al., issued Jul. 28, 1981 — An imaging member is disclosed comprising a substrate, an injecting contact, or hole injecting electrode overlying the substrate, a charge transport layer comprising an electrically inactive resin containing a dispersed electrically active material, a layer of charge generator material and a layer of insulating organic resin overlying the charge generating material. The charge transport layer can contain triphenylmethane.

U.S. Pat. No. 4,515,882 to Mammino et al, issued May 7, 1985 — An electrophotographic imaging system is disclosed which utilizes a member comprising at least one photoconductive layer and an overcoating layer comprising a film forming continuous phase comprising charge transport molecules and finely divided charge injection enabling particles dispersed in the continuous phase, the insulating overcoating layer being substantially transparent to activating radiation to which the photoconductive layer is sensitive and substantially electrically insulating at low electrical fields.

U.S. Pat. No. 4,599,286 to Limburg et al., issued Jul. 8, 1982 — An electrophotographic imaging member is disclosed comprising a charge generation layer and a charge transport layer, the transport layer comprising an aromatic amine charge transport molecule in a continuous polymeric binder phase and a chemical stabilizer selected from the group consisting of certain nitrone, isobenzofuran, hydroxyaromatic compounds and mixtures thereof. An electrophotographic imaging process using this member is also described.

In copending application entitled "LAYERED PHOTORECEPTOR STRUCTURES WITH OVERCOATINGS CONTAINING A TRIPHENYL METHANE" Ser. No. 07/997,412, filed on Dec. 28, 1992, an electrophotographic imaging member is disclosed comprising a substrate, a charge generating layer, a charge transport layer comprising charge transporting molecules dispersed in a first polymer binder, and an overcoat layer comprising a triphenyl methane molecule dispersed in a second polymer binder, the second polymer binder being soluble in a solvent in which the first polymer binder is insoluble. The overcoat layer may contain an optional charge transport molecule. The device may also include any suitable optional charge blocking, adhesive and other sub layers. This electrophotographic imaging member is fabricated by forming on a charge generating layer a first coating comprising charge transporting molecules dispersed in a solution of a first polymer binder dissolved in a first solvent, drying the coating to remove the solvent to form a substantially dry charge transport layer, forming on the charge transport layer a second coating comprising triphenyl methane molecules and charge transporting molecules dispersed in a solution of a second polymer binder dissolved in a second solvent, the first polymer binder being insoluble in the second solvent, and drying the second coating to remove the second solvent to form a substantially dry overcoat layer. This electrophotographic imaging member may be utilized in an electrophotographic imaging process. The entire disclosure of this copending application is incorporated herein by reference.

In copending application entitled "LONG LIFE PHOTORECEPTOR" Ser. No. 172,521, filed concurrently herewith, an electrophotographic imaging member is disclosed comprising a substrate, a charge generating layer, a charge transport layer, and an overcoat layer comprising a small molecule hole transporting triphenyl methane having at least one hydroxy functional group, and a polyamide film forming binder capable of forming hydrogen bonds with the hydroxy functional groups of the hydroxy triphenyl methane. This overcoat layer may be fabricated using an alcohol solvent. This electrophotographic imaging member may be utilized in an electrophotographic imaging process. The entire disclosure of this copending application is incorporated herein by reference.

In copending application entitled "PHOTORECEPTOR WITH LOW SURFACE ENERGY OVERCOAT" Ser. No. 170,480, filed concurrently herewith, an electrophotographic imaging member is disclosed comprising a substrate, a charge generating layer, a charge transport layer, and an overcoat layer comprising a small molecule hole transporting arylamine having at least two hydroxy functional groups, a hydroxy terminated dimethyl siloxane and a polyamide film forming binder capable of forming hydrogen bonds with the hydroxy functional groups on the hydroxy arylamine and hydroxy diorgano siloxane. This overcoat layer may be fabricated using an alcohol solvent. This electrophotographic imaging member may be utilized in an electrophotographic imaging process. The entire disclosure of this copending application is incorporated herein by reference.

Although acceptable images may be obtained when chemical triphenyl methanes are incorporated within the bulk of the charge transport layers, the photoreceptor can exhibit at least two deficiencies when subjected to extensive cycling. One is that the presence of the triphenyl methane in the bulk of the charge transport layer results in trapping of photoinjected holes from the generator layer into the transport layer giving rise to higher residual potentials. This can cause a condition known as cycle-up in which the residual potential continues to increase with multi-cycle operation. This can give rise to increased densities in the background areas of the final images. A second undesirable effect due to the addition of the triphenyl methane in the bulk of the transport layer is that some of these molecules migrate into the generator layer during the process of the fabrication of the transport layer. The presence of these molecules on the surface of the pigment in the generator layer could result in cyclic instabilities, particularly in long image cycling runs. These two deficiencies limits the concentration of the triphenyl methanes that can be added in the transport layer.

Where photoreceptors are overcoated, intermixing of the overcoat and the transport layers occur which can render the overcoat very ineffective. This intermixing leads to the incorporation of hydroxy triphenyl methanes in the bulk of the transport layer causing cycle-up. Also, the intermixing causes a reduction of the concentration of triphenyl methanes on the outer surface of the photoreceptor. The concentration of triphenyl methanes in the outer surface region of the photoreceptor prevents the aforementioned deletion.

Thus, there is a continuing need for photoreceptors having improved resistance to corona effluent induced deletions without increased densities in the background areas of the final images, migration of additives into the generator layer during fabrication of the transport layer, and cyclic instabilities.

SUMMARY OF THE INVENTION

It is, therefore, an object of the present invention to provide an improved electrophotographic imaging member which overcomes the above-noted deficiencies.

It is another object of the present invention to provide an improved electrophotographic imaging member exhibiting greater resistance to abrasion during image cycling.

It is yet another object of the present invention to provide an improved electrophotographic imaging member that resists leaching of components from the charge transport layer during liquid development.

It is still another object of the present invention to provide an improved electrophotographic imaging member which reduces crystallization of small molecules in those charge transport layers which contain a transporting molecule and binder.

It is another object of the present invention to provide an improved electrophotographic imaging member which is stable against copy defects such as print deletion.

It is yet another object of the present invention to provide an improved electrophotographic imaging member of greater abrasion resistance.

It is still another object of the present invention to provide an improved electrophotographic imaging member having greater stability against corona induced chemical changes.

It is another object of the present invention to provide an improved electrophotographic imaging member which avoids residual charge build up.

It is still another object of the present invention to provide an improved electrophotographic imaging member which is mechanically stronger.

It is yet another object of the present invention to provide an improved electrophotographic imaging member having an overcoating free of phase separation of component materials.

The foregoing objects and others are accomplished in accordance with this invention by providing an electrophotographic imaging member comprising a substrate, a charge generating layer, a charge transport layer, and an overcoat layer comprising a small molecule hole transporting arylamine having at least two hydroxy functional groups, a hydroxy or multihydroxy triphenyl methane and a polyamide film forming binder capable of forming hydrogen bonds with the hydroxy functional groups the hydroxy arylamine and hydroxy or multihydroxy triphenyl methane. This overcoat layer may be fabricated using an alcohol solvent. This electrophotographic imaging member may be utilized in an electrophotographic imaging process.

BRIEF DESCRIPTION OF THE DRAWINGS

FIG. 4 illustrates structural formula of a direct conjugation segment.

FIG. 5 illustrates structural formulae of compounds in which hydroxyl groups are in direct conjugation with nitrogen through a phenylene ring system.

FIGS. 6 and 7 illustrate structural formulae of hydroxy arylamine compounds.

Figure 1:
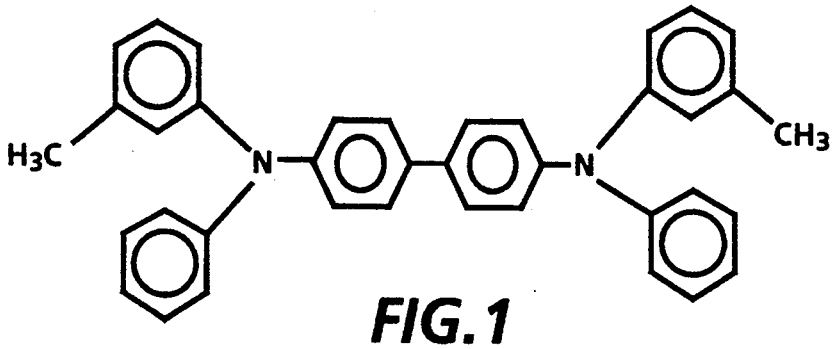
FIG. 1 illustrates a structural formula of an aromatic diamine molecule.

Electrophotographic imaging members are well known in the art. Electrophotographic imaging members may be prepared by any suitable technique. Typically, a flexible or rigid substrate is provided with an electrically conductive surface. A charge generating layer is then applied to the electrically conductive surface. A charge blocking layer may optionally be applied to the electrically conductive surface prior to the application of a charge generating layer. If desired, an adhesive layer may be utilized between the charge blocking layer and the charge generating layer. Usually the charge generation layer is applied onto the blocking layer and a charge transport layer is formed on the charge generation layer. This structure may have the charge generation layer on top of or below the charge transport layer.

The substrate may be opaque or substantially transparent and may comprise any suitable material having the required mechanical properties. Accordingly, the substrate may comprise a layer of an electrically nonconductive or conductive material such as an inorganic or an organic composition. As electrically non-conducting materials there may be employed various resins known for this purpose including polyesters, polycarbonates, polyamides, polyurethanes, and the like which are flexible as thin webs. An electrically conducting substrate may be any metal, for example, aluminum, nickel, steel, copper, and the like or a polymeric material, as described above, filled with an electrically conducting substance, such as carbon, metallic powder, and the like or an organic electrically conducting material. The electrically insulating or conductive substrate may be in the form of an endless flexible belt, a web, a rigid cylinder, a sheet and the like.

The thickness of the substrate layer depends on numerous factors, including strength desired and economical considerations. Thus, for a drum, this layer may be of substantial thickness of, for example, up to many centimeters or of a minimum thickness of less than a millimeter. Similarly, a flexible belt may be of substantial thickness, for example, about 250 micrometers, or of minimum thickness less than 50 micrometers, provided there are no adverse effects on the final electrophotographic device.

In embodiments where the substrate layer is not conductive, the surface thereof may be rendered electrically conductive by an electrically conductive coating. The conductive coating may vary in thickness over substantially wide ranges depending upon the optical transparency, degree of flexibility desired, and economic factors. Accordingly, for a flexible photoresponsive imaging device, the thickness of the conductive coating may be between about 20 angstroms to about 750 angstroms, and more preferably from about 100 angstroms to about 200 angstroms for an optimum combination of electrical conductivity, flexibility and light transmission. The flexible conductive coating may be an electrically conductive metal layer formed, for example, on the substrate by any suitable coating technique, such as a vacuum depositing technique or electrodeposition. Typical metals include aluminum, zirconium, niobium, tantalum, vanadium and hafnium, titanium, nickel, stainless steel, chromium, tungsten, molybdenum, and the like.

An optional hole blocking layer may be applied to the substrate. Any suitable and conventional blocking layer capable of forming an electronic barrier to holes between the adjacent photoconductive layer and the underlying conductive surface of a substrate may be utilized.

An optional adhesive layer may applied to the hole blocking layer. Any suitable adhesive layer well known in the art may be utilized. Typical adhesive layer materials include, for example, polyesters, polyurethanes, and the like. Satisfactory results may be achieved with adhesive layer thickness between about 0.05 micrometer (500 angstroms) and about 0.3 micrometer (3,000 angstroms). Conventional techniques for applying an adhesive layer coating mixture to the charge blocking layer include spraying, dip coating, roll coating, wire wound rod coating, gravure coating, Bird applicator coating, and the like. Drying of the deposited coating may be effected by any suitable conventional technique such as oven drying, infra red radiation drying, air drying and the like.

Charge generator layers may comprise amorphous films of selenium and alloys of selenium and arsenic, tellurium, germanium and the like, hydrogenated amorphous silicon and compounds of silicon and germanium, carbon, oxygen, nitrogen and the like fabricated by vacuum evaporation or deposition. The charge generator layers may also comprise inorganic pigments of crystalline selenium and its alloys; Group II–VI compounds; and organic pigments such as quinacridones, polycyclic pigments such as dibromo anthanthrone pigments, perylene and perinone diamines, polynuclear aromatic quinones, azo pigments including bis-, tris- and tetrakis-azos; and the like dispersed in a film forming polymeric binder and fabricated by solvent coating techniques.

Phthalocyanines have been employed as photogenerating materials for use in laser printers utilizing infrared exposure systems. Infrared sensitivity is required for photoreceptors exposed to low cost semiconductor laser diode light exposure devices. The absorption spectrum and photosensitivity of the phthalocyanines depend on the central metal atom of the compound. Many metal phthalocyanines have been reported and include, oxyvanadium phthalocyanine, chloroaluminum phthalocyanine, copper phthalocyanine, oxytitanium phthalocyanine, chlorogallium phthalocyanine, hydroxygallium phthalocyanine magnesium phthalocyanine and metal-free phthalocyanine. The phthalocyanines exist in many crystal forms which have a strong influence on photogeneration.

Any suitable polymeric film forming binder material may be employed as the matrix in the charge generating (photogenerating) binder layer. Typical polymeric film forming materials include those described, for example, in U.S. Pat. No. 3,121,006, the entire disclosure of which is incorporated herein by reference. Thus, typical organic polymeric film forming binders include thermoplastic and thermosetting resins such as polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl acetate, polysiloxanes, polyacrylates, polyvinyl acetals, polyamides, polyimides, amino resins, phenylene oxide resins, terephthalic acid resins, phenoxy resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly(amideimide), styrene-butadiene copolymers, vinylidenechloride-vinylchloride copolymers, vinylacetate-vinylidenechloride copolymers, styrene-alkyd resins, polyvinylcarbazole, and the like. These polymers may be block, random or alternating copolymers.

The photogenerating composition or pigment is present in the resinous binder composition in various amounts. Generally, however, from about 5 percent by volume to about 90 percent by volume of the photogenerating pigment is dispersed in about 10 percent by volume to about 95 percent by volume of the resinous binder, and preferably from about 20 percent by volume to about 30 percent by volume of the photogenerating pigment is dispersed in about 70 percent by volume to about 80 percent by volume of the resinous binder composition. In one embodiment about 8 percent by volume of the photogenerating pigment is dispersed in about 92 percent by volume of the resinous binder composition. The photogenerator layers can also fabricated by vacuum sublimation in which case there is no binder.

Any suitable and conventional technique may be utilized to mix and thereafter apply the photogenerating layer coating mixture. Typical application techniques include spraying, dip coating, roll coating, wire wound rod coating, vacuum sublimation and the like. For some applications, the generator layer may be fabricated in a dot or line pattern. Removing of the solvent of a solvent coated layer may be effected by any suitable conventional technique such as oven drying, infrared radiation drying, air drying and the like.

The charge transport layer may comprise a charge transporting small molecule dissolved or molecularly dispersed in a film forming electrically inert polymer such as a polycarbonate. The term "dissolved" as employed herein is defined herein as forming a solution in which the small molecule is dissolved in the polymer to form a homogeneous phase. The expression "molecularly dispersed" is used herein is defined as a charge transporting small molecule dispersed in the polymer, the small molecules being dispersed in the polymer on a molecular scale. Any suitable charge transporting or electrically active small molecule may be employed in the charge transport layer of this invention. The expression charge transporting "small molecule" is defined herein as a monomer that allows the free charge photogenerated in the transport layer to be transported across the transport layer. Typical charge transporting small molecules include, for example, pyrazolines such as 1-phenyl-3-(4'-diethylamino styryl)-5-(4''- diethylamino phenyl)pyrazoline, diamines such as N,N'-diphenyl-N,N'-bis(3-methylphenyl)-(1,1'-biphenyl)-4,4'-diamine, hydrazones such as N-phenyl-N-methyl-3-(9-ethyl)carbazyl hydrazone and 4-diethyl amino benzaldehyde-1,2-diphenyl hydrazone, and oxadiazoles such as 2,5-bis (4-N,N'-diethylaminophenyl)-1,2,4-oxadiazole, stilbenes and the like. However, to avoid cycle-up in machines with high throughput, the charge transport layer should be substantially free (less than about two percent) of triphenyl methane. As indicated above, suitable electrically active small molecule charge transporting compounds are dissolved or molecularly dispersed in electrically inactive polymeric film forming materials. A small molecule charge transporting compound that permits injection of holes from the pigment into the charge generating layer with high efficiency and transports them across the charge transport layer with very short transit times is N,N'-diphenyl-N,N'-bis(3-methylphenyl)-(1,1'-biphenyl)-4,4'-diamine represented by the formula shown in FIG. 1.

Figure 2:
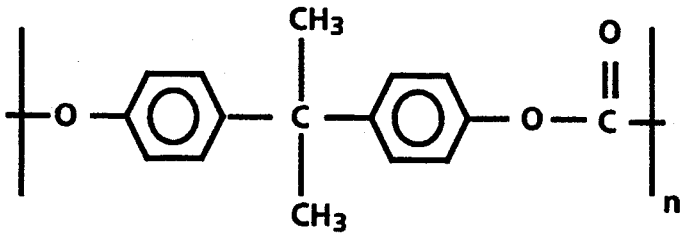
FIG. 2 illustrates a structural formula of a polycarbonate binder segment.

The electrically inert polymeric binder generally used to disperse the electrically active molecule in the charge transport layer is a poly(4,4'-isopropylidenediphenylene)carbonate (also referred to as bisphenol-A-polycarbonate represented by the formula shown in FIG. 2. The electrically inert polymer binder can also be poly(4,4'-cyclohexylidinediphenylene) carbonate (referred to as bisphenol-Z polycarbonate) represented by the formula shown in FIG. 16.

Figure 12:
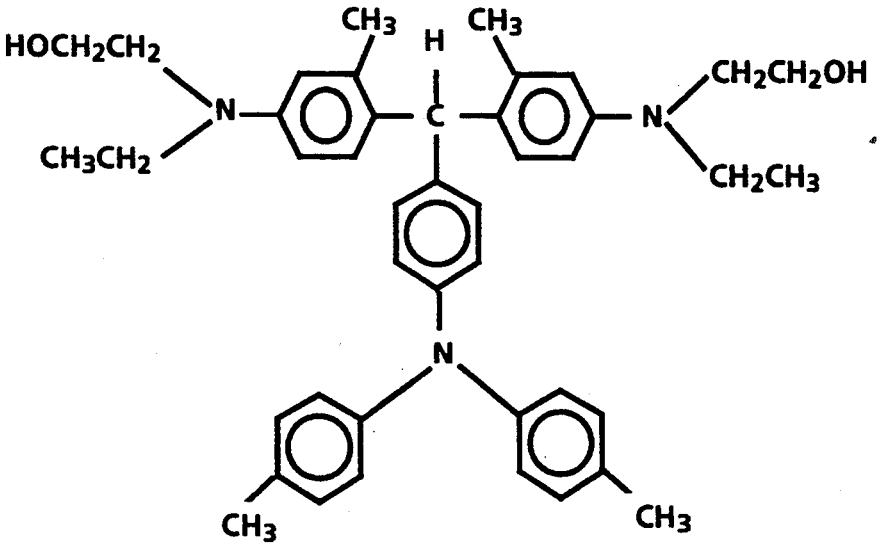
Figure 13:
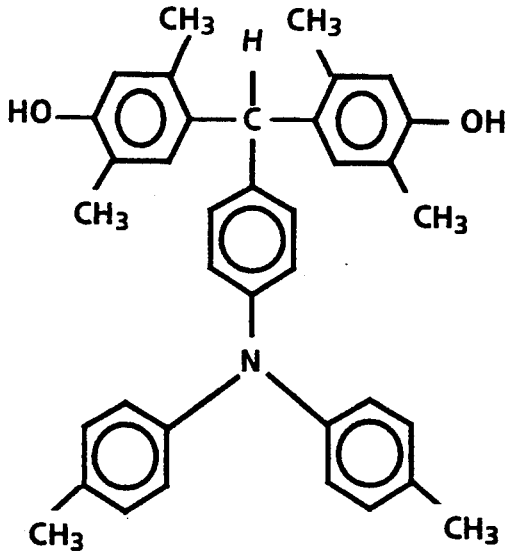
Figure 14:
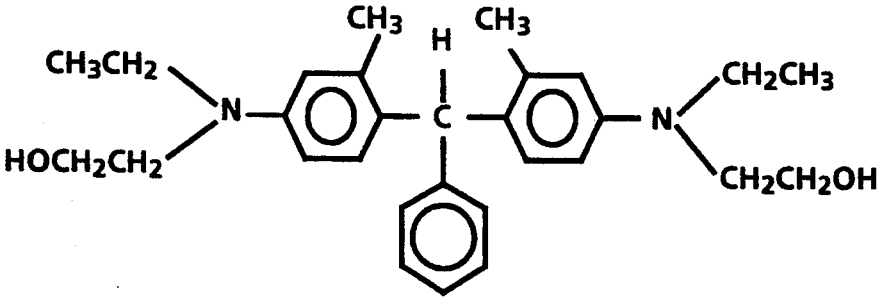
Figure 15:
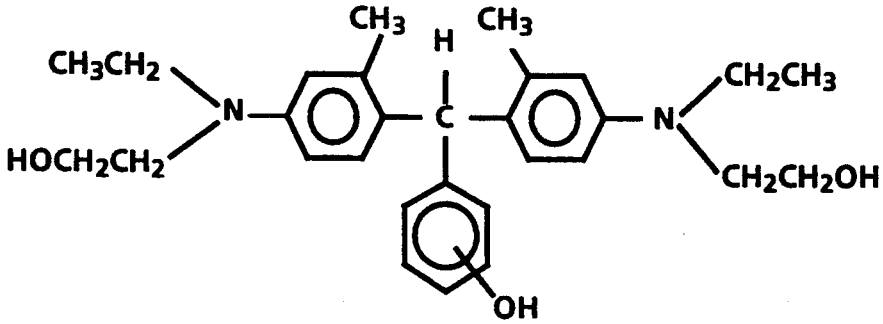

Any suitable electrically inactive resin binder insoluble in the alcohol solvent used to apply the overcoat layer may be employed in the charge transport layer of this invention. Typical inactive resin binders include polycarbonate resin, polyester, polyarylate, polyacrylate, polyether, polysulfone, and the like. Molecular weights can vary, for example, from about 20,000 to about 150,000. Any suitable charge transporting polymer of the type shown in FIG. 12 may also be utilized in the charge transporting layer of this invention. These electrically active charge transporting polymeric materials should be capable of supporting the injection of photogenerated holes from the charge generation material and incapable of allowing the transport of these holes therethrough.

Any suitable and conventional technique may be utilized to mix and thereafter apply the charge transport layer coating mixture to the charge generating layer. Typical application techniques include spraying, dip coating, roll coating, wire wound rod coating, and the like. Drying of the deposited coating may be effected by any suitable conventional technique such as oven drying, infra red radiation drying, air drying and the like.

Generally, the thickness of the charge transport layer is between about 10 and about 50 micrometers, but thicknesses outside this range can also be used. The hole transport layer should be an insulator to the extent that the electrostatic charge placed on the hole transport layer is not conducted in the absence of illumination at a rate sufficient to prevent formation and retention of an electrostatic latent image thereon. In general, the ratio of the thickness of the hole transport layer to the charge generator layers is preferably maintained from about 2:1 to 200:1 and in some instances as great as 400:1. The charge transport layer, is substantially non-absorbing to visible light or radiation in the region of intended use but is electrically "active" in that it allows the injection of photogenerated holes from the photoconductive layer, i.e., charge generation layer, and allows these holes to be transported through itself to selectively discharge a surface charge on the surface of the active layer.

If desired the electrophotographic imaging member of this invention may comprise a supporting substrate, a charge transport layer, charge generating layer and an overcoating layer instead of a supporting substrate, charge generating layer, a charge transport layer and an overcoating layer. Where the charge generating layer overlies the charge transport layer, the components of the charge generating layer should be insoluble in the alcohol solvent employed to apply the overcoat layer of this invention.

The overcoat layer of this invention comprises at least a polyamide film forming binder which is soluble in and coated from alcohol, a polyhydroxy arylamine charge transporting molecule, and a hydroxy triphenyl methane molecule which functions both as a stabilizer and as a charge transporting molecule. All the components utilized in the overcoating of this invention should be soluble in a common alcohol solvent. When at least one component in the overcoating mixture is not soluble in the solvent utilized, phase separation can occur which would adversely affect the transparency of the overcoating and electrical performance of the final photoreceptor.

Any suitable alcohol soluble polyamide film forming binder capable for forming hydrogen bonds with hydroxy functional materials may be utilized in the overcoating of this invention. The expression "hydrogen bonding" is defined as an attractive force or bridge occurring between the polar hydroxy containing arylamine and a hydrogen bonding resin in which a hydrogen atom of the polar hydroxy arylamine is attracted to two unshared electrons of a resin containing polarizable groups. The hydrogen atom is the positive end of one polar molecule and forms a linkage with the electronegative end of the other polar molecule. The polyamide utilized in the overcoating of this invention should also have sufficient molecular weight to form a film upon removal of the solvent and also be soluble in alcohol. Generally, the weight average molecular weights of polyamides vary from about 5,000 to about 1,000,000. Since some polyamides absorb water from the ambient atmosphere, its electrical property may vary to some extent with changes in humidity in the absence of a polyhydroxy arylamine charge transporting monomer, the addition of polyhydroxy arylamine charge transporting monomer minimizes these variations. The alcohol soluble polyamide should be capable of dissolving in an alcohol solvent which also dissolves the hole transporting small molecule having multiple hydroxy functional groups. The polyamide polymers of this invention are characterized by the the presence of the amide group —CONH. Typical polyamides include the various Elvamide resins which are nylon multipolymer resins, such as the alcohol soluble Elvamide and Elvamide TH resins. Elvamide resins are available from E.I. DuPont Nemours and Company. Other examples of polyamides include Elvamide 8061, Elvamide 8064, Elvamide 8023.

When the overcoat layer contains only polyamide binder material, the layer tends to absorb moisture from the ambient atmosphere and becomes soft and hazy. This adversely affects the electrical properties, the cycling life, and sensitivity of the overcoated photoreceptor.

Figure 3A:
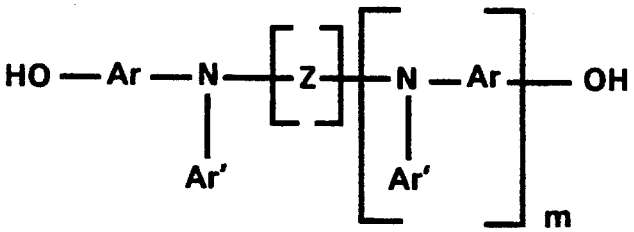
FIGS. 3*a* to 3*e* illustrate a generic structural formula of a small molecule hole transporting hydroxy arylamine.
Figure 3B:
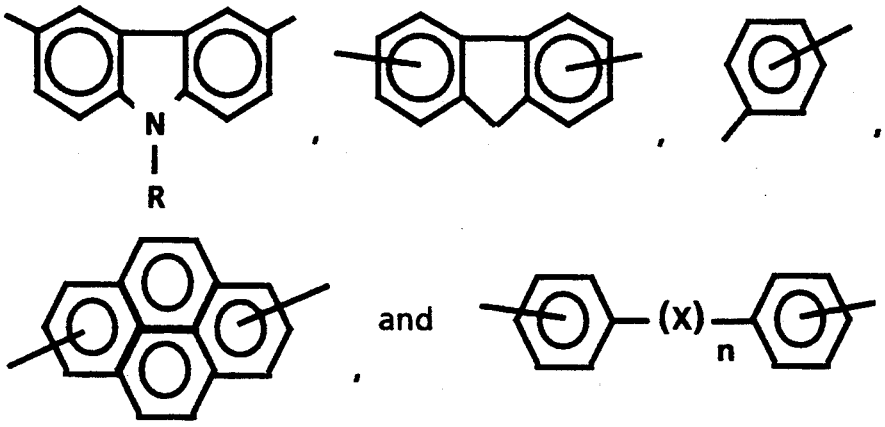
Figure 3C:
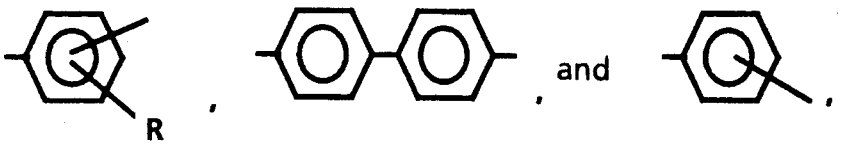
Figure 3D:
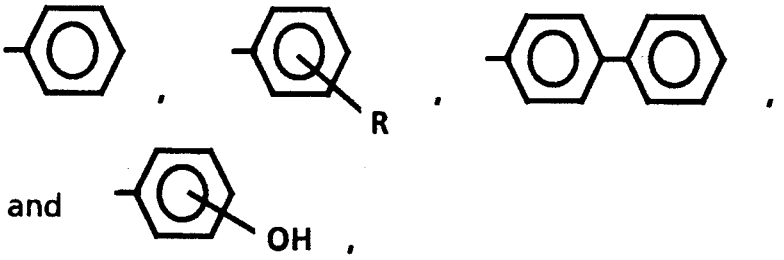
Figure 3E:
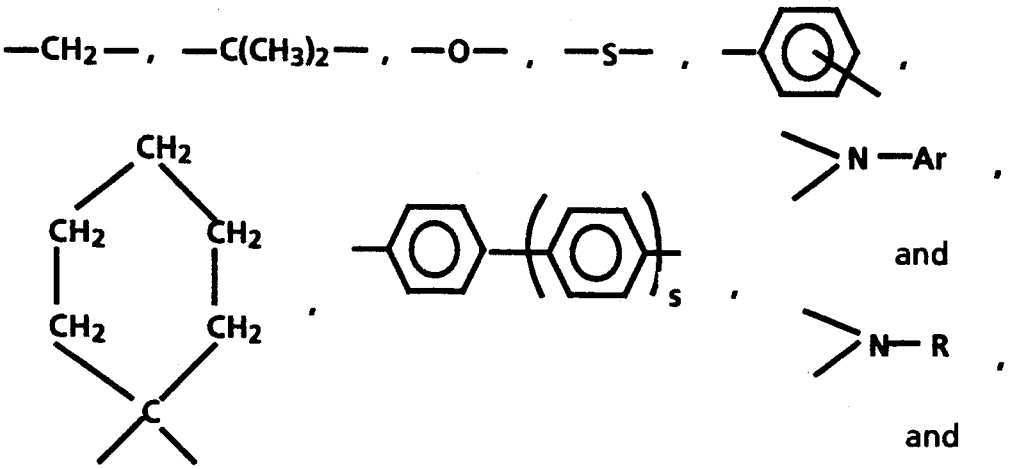

Any suitable polyhydroxy diaryl amine small molecule charge transport material having at least two hydroxy functional groups may be utilized in the overcoating layer of this invention. A preferred small molecule hole transporting material can be represented by the following formula shown in FIG. 3*a*.

wherein:

m is 0 or 1,

Z is selected from the group consisting of the groups shown in FIG. 3*b*, n is 0 or 1, Ar is selected from the group consisting of the groups shown in FIG. 3*c*, R is selected from the group consisting of $—CH_3$, $—C_2H_5$, $—C_3H_7$, and $—C_4H_9$, Ar′ is selected from the group consisting of the groups shown in FIG. 3*e*, X is selected from the group consisting of the groups shown in FIG. 3*f*, s is0, 1 or 2, the dihydroxy arylamine compound being free of any direct conjugation between the —OH groups and the nearest nitrogen atom through one or more aromatic rings.

The expression "direct conjugation" is defined as the presence of a segment, having the formula shown in FIG. 4, in one or more aromatic rings directly between an —OH group and the nearest nitrogen atom. Examples of direct conjugation between the —OH groups and the nearest nitrogen atom through one or more aromatic rings include a compound containing a phenylene group having an —OH group in the ortho or para position (or 2 or 4 position) on the phenylene group relative to a nitrogen atom attached to the phenylene group or a compound containing a polyphenylene group having an —OH group in the ortho or para position on the terminal phenylene group relative to a nitrogen atom attached to an associated phenylene group.

The two structures shown in FIG. 5 are illustrative examples of specific compounds in which the hydroxyl group is in direct conjugation with the nitrogen through a phenylene ring system.

Typical polyhydroxy arylamine compounds utilized in the overcoat of this invention include, for example: N,N′-diphenyl-N,N′-bis(3-hydroxyphenyl)-[1,1′- biphenyl]-4,4'-diamine; N,N,N',N',-tetra(3-hydroxyphenyl)-[1,1'-biphenyl]-4,4'-diamine ; N,N-di(3-hydroxyphenyl)-m-toluidine; 1,1-bis-[4-(di-N,N-m-hydroxyphenyl)-aminophenyl]-cyclohexane; 1,1 -bis[4-(N-m-hydroxyphenyl)-4-(N-phenyl)-aminophenyl]-cyclohexane ; Bis-(N-(3-hydroxyphenyl)-N-phenyl-4-aminophenyl)-methane; Bis[(N-(3-hydroxyphenyl)-N-phenyl)-4-aminophenyl]-isopropylidene; N,N'-diphenyl-N,N'-bis(3-hydroxyphenyl)-[1,1':4',1''-terphenyl]-4,4''-diamine; 9-ethyl-3.6-bis[N-phenyl-N-3(3-hydroxyphenyl)-amino]-carbazole ; 2,7-bis[N,N-di(3-hydroxyphenyl)-amino]-fluorene; 1,6-bis[N,N-di(3-hydroxyphenyl)-amino]-pyrene; 1,4-bis[N-phenyl-N-(3-hydroxyphenyl)]-phenylenediamine. Structural formulae for some of these polyhydroxy arylamine compounds are illustrated in FIGS. 6 and 7.

Typical hydroxy arylamine compounds containing direct conjugation between the —OH groups and the nearest nitrogen atom through one or more aromatic rings include, for example: N,N'-diphenyl-N-N'-bis(4-hydroxy phenyl)[1,1'-biphenyl]-4,4'-diamine N,N,N',N',-tetra(4-hydroxyphenyl)-[1,1'-biphenyl]-4,4'-diamine; N,N-di(4-hydroxyphenyl )-m-toluidine; 1,1-bis-[4-(di-N,N-p-hydroxyphenyl)-aminophenyl]-cyclohexane ; 1,1-bis[4-(N-o-hydroxyphenyl)-4-(N-phenyl)-aminophenyl]-cyclohexane ; Bis-(N-(4-hydroxyphenyl)-N-phenyl-4-aminophenyl)-methane ; Bis[(N-(4-hydroxyphenyl)-N-phenyl)-4-aminophenyl]-isopropylidene ; Bis-N,N-[(4'-hydroxy-4-(1,1'-biphenyl)]-aniline; Bis-N,N-[(2'-hydroxy-4-(1,1'-biphenyl)]-aniline and the like.

Charge transporting polyhydroxy arylamine compound are known and are described, for example in U.S. Pat. No. 4,871,634, the entire disclosure thereof being incorporated herein by reference.

Figure 8:
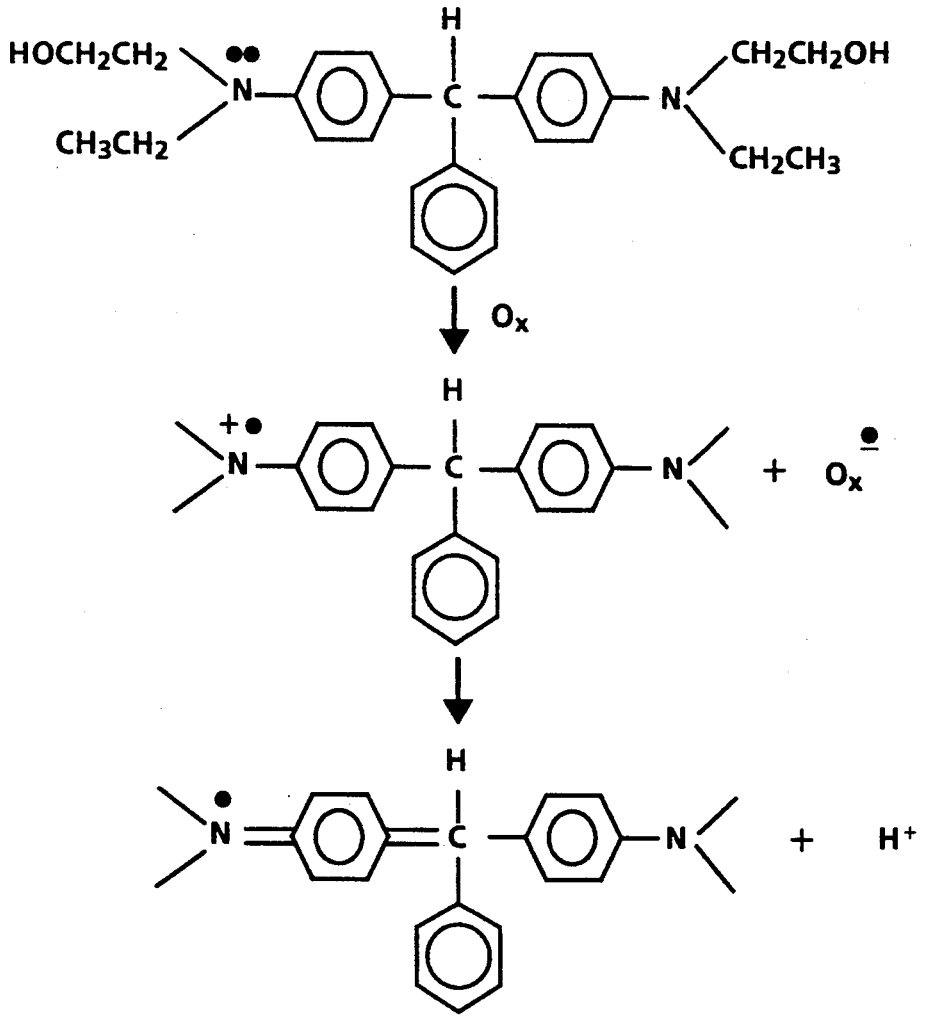
FIG. 8 illustrates electron transfer from a stabilizer to an oxidizing agent.

The overcoating layer of this invention also contains at least one hydroxy triphenyl methane stabilizer material. The hydroxy triphenyl methane stabilizer material should contain at least one hydroxy functional group and, more preferably, at least two hydroxy functional groups. There does not appear to be any limitation as to the maximum number of hydroxy functional groups attached to the hydroxy triphenyl methane stabilizer molecule. The hydroxyl groups attached to the triphenyl methane family of molecules interact so strongly with polyamide binders capable of forming hydrogen bonds that they cannot separate. Additionally, these hydroxy triphenyl methane molecules are soluble in alcohol which must also be used as the solvent for the polyamide binder and hydroxy arylamines. The presence of hydroxy triphenyl methanes in the overcoat increases its stability against deletion compared to overcoats containing only the hydroxy arylamine and polyamide binder. The overcoat composition of polyhydroxy arylamine small molecule transport molecule, hydroxy triphenyl methane and polyamide provides sufficient charge transport capabilities to the overcoat to prevent residual build up and improved stability against corona induced chemical changes. Although the precise nature for stabilization to the oxidizing environment of corona is not known, it is believed that the stabilization mechanism may initially involve an electron transfer from the stabilizer to the oxidizing agent, herein referred to as Ox, followed by a disproportion reaction of the triphenyl methane moiety. An example this is illustrated in FIG. 8.

Figure 9:
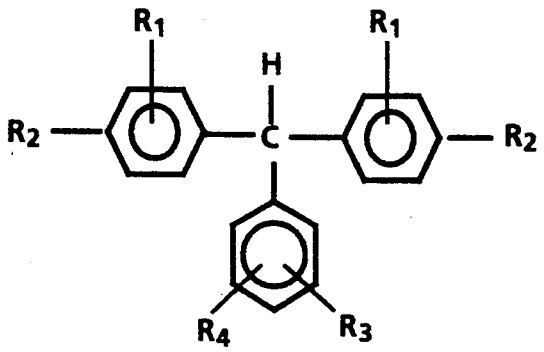
FIG. 9 illustrates a generic structural formula for hydroxy triphenyl methane.
Figure 10:
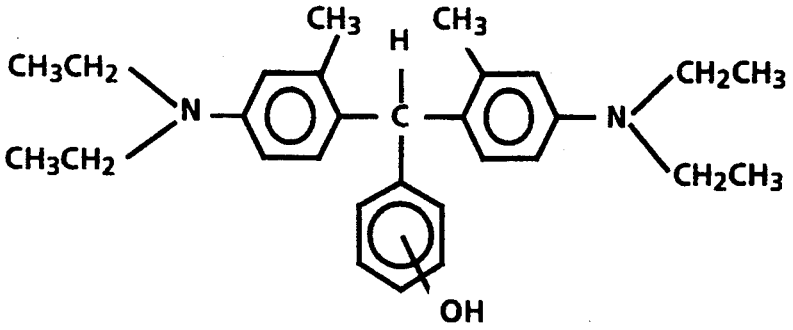
FIGS. 10–17 illustrate structural formulae of hydroxy triphenyl methane compounds.
Figure 11:
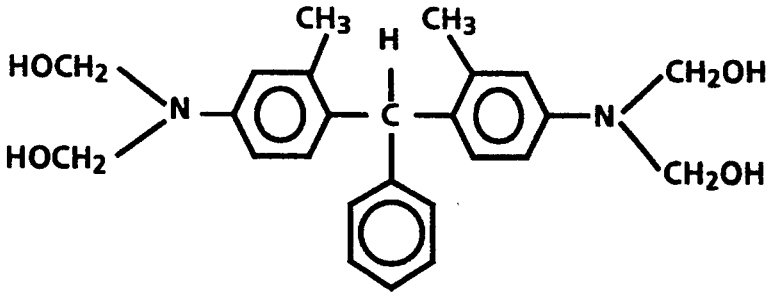

Hydroxy triphenyl methane stabilizer molecules of this invention is represented by the generic formula shown in FIG. 9 wherein $R_1$, $R_2$, $R_3$, and $R_1$, are independently selected from the group consisting of:

$-CH_3$, $-H$, $-OH$, $-N(CH_2CH_3)$,

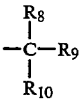

wherein $R_8$, $R_9$ and $R_{10}$ are independently selected from H, $-(CH_2-)n'''CH_3$ wherein n''' is an integer from 0 to 6,

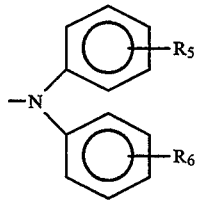

wherein $R_5$ and $R_6$ are independently selected from the group consisting of H, $-(CH_2)_{n'''}CH_3$ wherein n''' is an integer from 0 to 6,

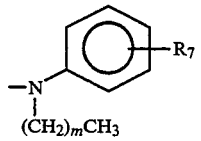

wherein $R_7$ is independently selected from H, $-(CH_2)_{n''''}CH_3$ wherein n'''' and m are an integer from 0 to 6, $-N(CH_3)CH_2CH_2OH$, $-N(CH_2)_nCH_3(CH_2)_{n'}OH$ wherein n is an integer from 0 to 6 and n' is an integer from 1 to 6, $-N[(CH_2)n''\ CH_2OH]_2$ wherein n'' is an integer from 0 to 6, wherein at least one or more of $R_1$, $R_2$, $R_3$, or $R_4$ must contain at least one hydroxy group, and wherein at least one or more of $R_1$, $R_2$, $R_3$, or R4 must contain at least one amino group.

Typical hydroxy triphenyl methane stabilizer stabilizer molecules are represented by the formulae in FIGS. 10 through 17.

Figure 18:
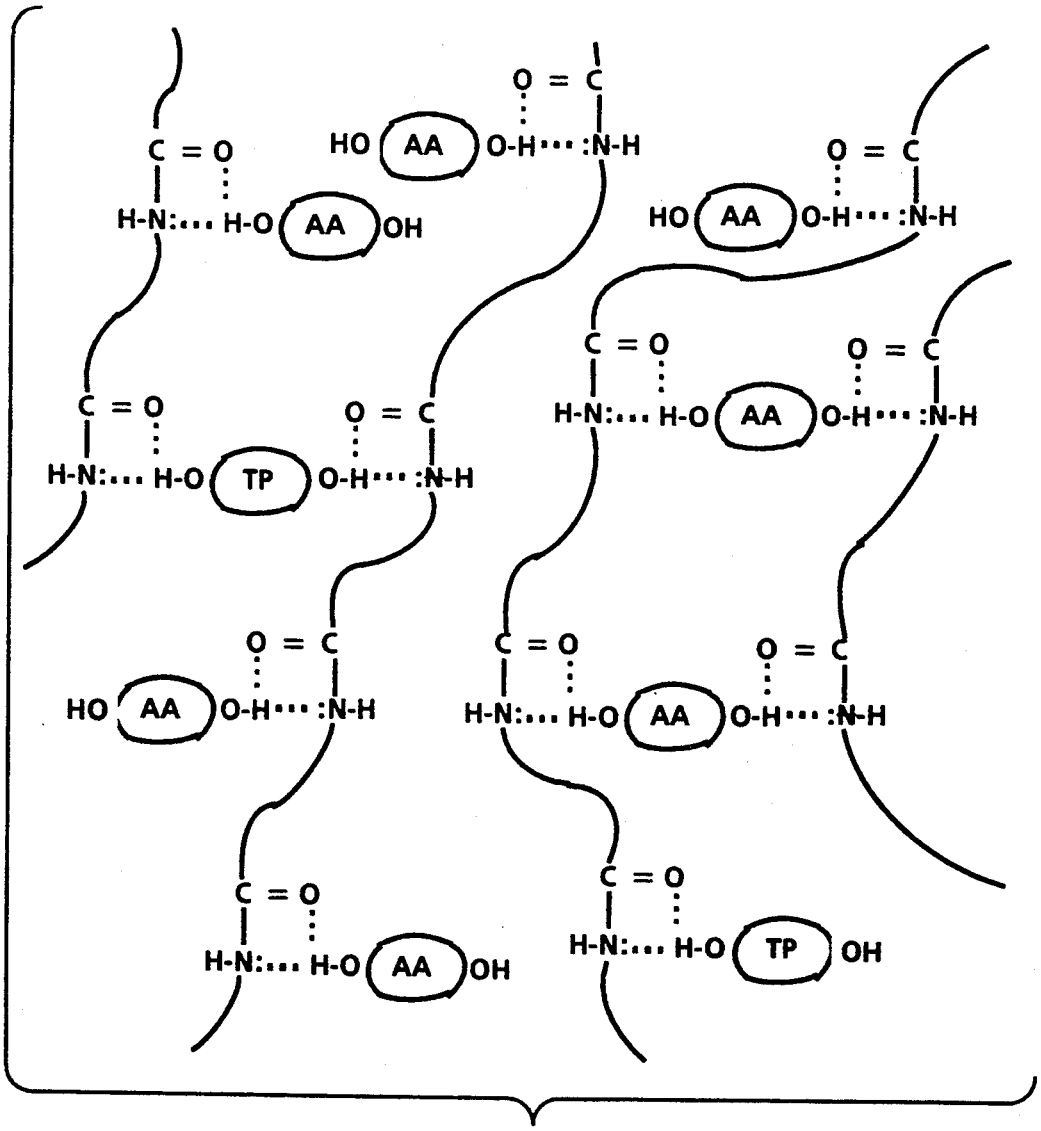
FIG. 18 illustrates a simplified depiction of hydroxy arylamine and hydroxy triphenyl amine charge transport molecules hydrogen bonded to polyamide polymer segments in the overcoat layer of this invention.

In the FIG. 18, a representation is illustrated of hydrogen bond formation between hydroxy groups of polyhydroxy arylamine hole transport molecules, hydroxy triphenyl amine charge transport molecules, and amide linkages of polyamide binder molecules capable of forming hydrogen bonds with the hydroxy functional groups of the hole transport molecules.

Any suitable alcohol may be employed to apply the overcoating composition of this invention. The alcohol selected should dissolve the polyhydroxy arylamine, the hydroxy triphenylmethane, and the polyamide utilized in the overcoating layer. The alcohol solvent should not dissolve any binder in the underlying layer. The use of an alcohol solvent minimizes the impact of the coating process on the environment. The alcohol should contain at least one hydroxy functional group per molecule. Typical alcohols containing at least one hydroxy functional group per molecule include, for example, isopropanol, methanol, ethanol, butanol, n-propanol, and the like. Alcohols with more than one hydroxy group per molecule include, for example, glycol, and the like. Satisfactory results may be achieved when the amount of alcohol utilized is between about 99 percent by weight and about 70 percent by weight based on the total weight of the coating composition. Generally, the optimum amount of alcohol utilized depends upon the particular type of coating process utilized to apply the overcoating material.

Figure 16:
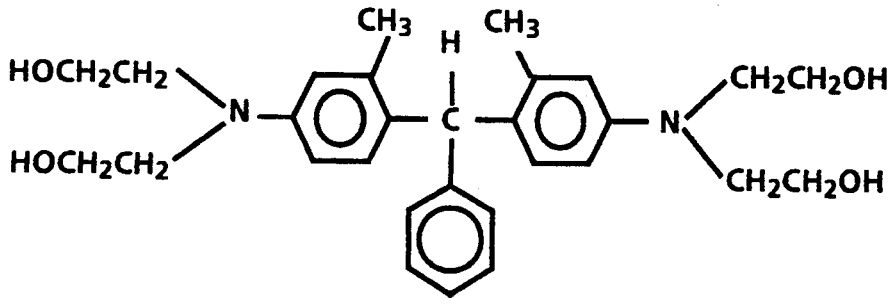
Figure 17:
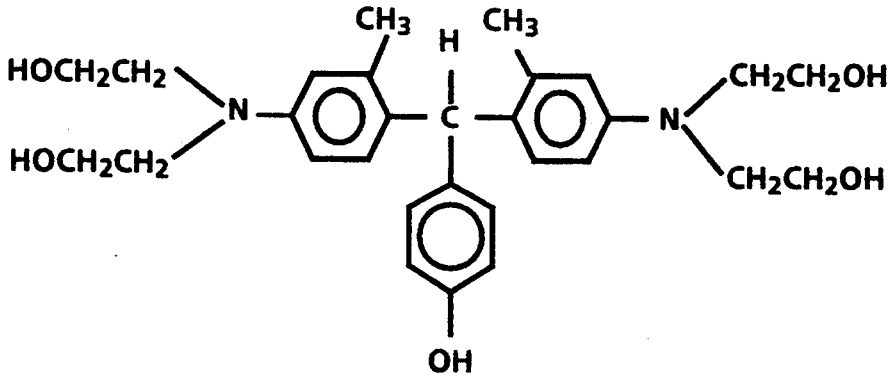

A simplified depiction of polyhydroxy arylamine and hydroxy triphenyl amine charge transport molecules hydrogen bonded to polyamide polymer segments in the overcoat layer of this invention is illustrated in FIG. 16 where "AA" represents polyhydroxy arylamine molecules and "TP" represents polyhydroxy triphenylmethane molecules.

The concentration of the polyhydroxy arylamine charge transporting molecules in the overcoat can be between 20 and about 50 percent by weight based on the total weight of the dried overcoat. When the proportion of polyhydroxy arylamine small molecule hole transporting molecule in the overcoating is less than about 20 percent by weight, a residual voltage may develop with cycling resulting in background problems. When the proportion of poly hydroxy arylamine small molecule charge transport material in the overcoating layer exceeds about 50 percent by weight based on the total weight of the overcoating layer, crystallization may occur resulting in residual cycle-up. In addition, mechanical properties, abrasive wear properties are negatively impacted. The presence of excess polyhydroxyarylamine material can increase the layers susceptibility to corona induced deletions. The concentration of the hydroxy triphenyl methane molecule in the overcoat layer is between about 0.5 percent and about 50 percent by weight based on the total weight of the dried overcoat. When less than about 0.5 percent by weight of hydroxy triphenyl methane molecule is present in the overcoat, the beneficial results of resistance to print deletion is less pronounced. When the proportion of hydroxy triphenylmethane small molecule charge transport material in the overcoating layer is greater than about 20 percent by weight based on the total weight of the overcoating layer, increases in residual voltages can be seen with long term cycling. In addition, mechanical and abrasive wear properties can be negatively impacted. The total combined concentration of the hydroxy aryl amine and hydroxy triaryl methane should be between about 5 percent and about 50 percent by weight based on the total weight of the dried overcoat, the remainder normally being the polyamide binder.

Any suitable coating technique may be utilized to form the overcoating layer. Typical coating techniques include spraying, extrusion coating, roll coating, veneer coating, dip coating, slide coating, slot coating, wire wound rod coating, and the like.

Any suitable technique may be utilized to dry the overcoating. Typical drying techniques include oven drying, forced air oven drying, radiant heat drying, and the like.

The thickness of the dried overcoat layer should be uniform and continuous. It can range in thickness from a mono molecular thickness up to a maximum thickness about about 10 micrometers. Generally, thicker coatings may be utilized for slower electrophotographic copier and printers.

If desired, the outer surface of the overcoating layer may be imparted with a texture to minimize the formation of moray patterns. The texture may be achieved by any suitable means such as embossing, regulation of drying conditions, and the like.

Generally, when large amounts of a charge transporting molecule material is added to an overcoating layer, the strength of the overcoating layer is reduced. Surprisingly, the overcoating layer of this invention becomes tougher when large amounts of small molecule arylamine and triphenyl methane charge transport material having at least two hydroxy functional groups are incorporated into the overcoating layer of this invention. When arylamine charge transport material having at least two hydroxy functional groups and triphenyl methane charge transport material having at least one hydroxy functional group are blended with polyamide binder capable of hydrogen bonding to achieve hydrogen bonding, the combination of materials restricts the absorption of atmospheric moisture into the polyamide polymer thereby eliminating the plasticizing effect of the water. Moisture tends to lessen overcoating abrasion and wear resistance when the overcoating contains only the polyamide. Unlike coatings containing small molecule charge transport material dissolved or molecularly dispersed in polycarbonate binder, the hydrogen bonded overcoat layer is compositionally stable and does not phase separate even when exposed to liquid ink media.

Figure 19:
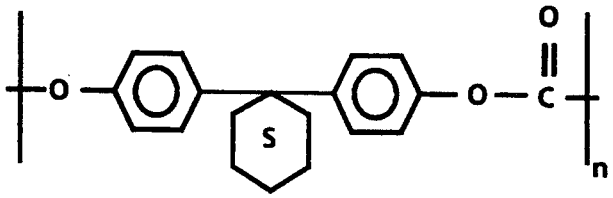
FIG. 19 illustrates a structural formula of a polycarbonate binder segment.

The film forming binder for the transport layer should not dissolve in the alcohol solvent selected for the overcoating layer. For example, charge transport layer binders such as polycarbonates do not dissolve in alcohol. Thus, for example, poly(4,4'-isopropylidenediphenylene) carbonate (i.e. bisphenol-A-polycarbonate) or poly(4,4'-cyclohexylidine-diphenylene) carbonate (also referred to as bisphenol-Z-polycarbonate), having a structure represented by the formula shown in FIG. 19, do not dissolve in alcohols such as ethanol, n-propanol, isopropanol, methanol, butanol, and the like. Bisphenol-A-polycarbonate dissolves in methylene chloride and bisphenol-Z-polycarbonate is soluble in toluene. Other polymers insoluble in alcohols include, for example polystyrene, polyethercarbonate, polyesters, and the like. The expression "soluble" as employed herein is defined as capable of forming a solution with which a film can be applied to a surface and dried to form a continuous coating. The expression "insoluble" as employed herein is defined as not capable of forming a solution so that the solvent and the solid remain in two separate phases and a continuous coating cannot be formed. Molecular weights of the polymers can vary, for example, from about 20,000 to about 150,000.

The composition and materials employed in the overcoat layer must meet several requirements: (1) it should be charge transporting to prevent a residual build up across the overcoat, and (2) it should not intermix into the charge transport layer during the process of fabricating the overcoat. The second requirement can be met by the judicious selection of binders for the charge transport layer and the overcoat layers whereby the polymer binder for the overcoat is soluble in a solvent in which the polymer binder for the charge transport layer is insoluble.

Other suitable layers may also be used such as a conventional electrically conductive ground strip along one edge of the belt or drum in contact with the conductive surface of the substrate to facilitate connection of the electrically conductive layer of the photoreceptor to ground or to an electrical bias. Ground strips are well known and usually comprise conductive particles dispersed in a film forming binder.

In some cases an anti-curl back coating may be applied to the side opposite the photoreceptor to provide flatness and/or abrasion resistance for belt or web type photoreceptors. These anti-curl back coating layers are well known in the art and may comprise thermoplastic organic polymers or inorganic polymers that are electrically insulating or slightly semiconducting.

The photoreceptor of this invention may be used in any conventional electrophotographic imaging system. As described above, electrophotographic imaging usually involves depositing a uniform electrostatic charge on the photoreceptor, exposing the photoreceptor to a light image pattern to form an electrostatic latent image on the photoreceptor, developing the electrostatic latent image with electrostatically attractable marking particles to form a visible toner image, transferring the toner image to a receiving member and repeating the depositing, exposing, developing and transferring steps at least once.

A number of examples are set forth hereinbelow and are illustrative of different compositions and conditions that can be utilized in practicing the invention. All proportions are by weight unless otherwise indicated. It will be apparent, however, that the invention can be practiced with many types of compositions and can have many different uses in accordance with the disclosure above and as pointed out hereinafter.

TEST PROCEDURES UTILIZED IN FOLLOWING EXAMPLES

Wear Characterization

A turntable device was fitted with a polyurethane blade configured in the doctor mode, the blade was adjustable for reproducible setting of the nip gap, a metered dispenser was used to feed specific quantities of a single component developer from the 5012, 5014 and 1012 electrophotographic imaging machines were used in the abrading agent, at predetermined intervals onto a rotating sample platen, and a tachometer and timer were used to calculate the number of elapsed sample rotations. This device was employed to test wear of materials by abrasion. Wear was calculated in terms of nanometers/kilocycles of rotation (nm/Kc). Reproducibility of calibration standards was about ±2 nm/Kc. Sample wear was measured by an interference measuring device, known as an Otsuka gauge.

Scanner Characterization

Each photoconductor device to be evaluated is mounted on a cylindrical aluminum drum substrate which is rotated on a shaft. The device is charged by a corotron mounted along the periphery of the drum. The surface potential is measured as a function of time by capacitively coupled voltage probes placed at different locations around the shaft. The probes are calibrated by applying known potentials to the drum substrate. The devices on the drums are exposed by a light source located at a position near the drum downstream from the corotron. As the drum is rotated, the initial (pre-exposure) charging potential is measured by voltage probe 1. Further rotation leads to the exposure station, where the photoconductor device is exposed to monochromatic radiation of known intensity. The device is erased by light source located at a position upstream of charging. The measurements made include charging of the photoconductor device in a constant current or voltage mode. The device is charged to a negative polarity corona. As the drum is rotated, the initial charging potential is measured by voltage probe 1. Further rotation leads to the exposure station, where the photoconductor device is exposed to monochromatic radiation of known intensity. The surface potential after exposure is measured by voltage probes 2 and 3. The device is finally exposed to an erase lamp of appropriate intensity and any residual potential is measured by voltage probe 4. The process is repeated with the magnitude of the exposure automatically changed during the next cycle. The photodischarge characteristics is obtained by plotting the potentials at voltage probes 2 and 3 as a function of light exposure. The charge acceptance and dark decay can also be measured in the scanner.

Parking Deletion Test

A negative corotron is operated (with high voltage connected to the corotron wire) opposite a grounded electrode for several hours. The high voltage is turned off, and the corotron is placed (or parked) for thirty minutes on a segment of the photoconductor device being tested. Only a short middle segment of the device is thus exposed to the corotron effluents. Unexposed regions on either side of the exposed regions are used as controls. The photoconductor device is then tested in a scanner for positive charging properties for systems employing donor type molecules. These systems are operated with negative polarity corotron in the latent image formation step. An electrically conductive surface region (excess hole concentration) appears as a loss of positive charge acceptance or increased dark decay in the exposed regions (compared to the unexposed control areas on either side of the short middle segment) Since the electrically conductive region is located on the surface of the device, a negative charge acceptance scan is not affected by the corotron effluent exposure (negative charges do not move through a charge transport layer made up of donor molecules). However, the excess carriers on the surface cause surface conductivity resulting in loss of image resolution and, in severe cases, causes deletion.

EXAMPLE I

A 20 cm (8 inch)×20 cm (8 inch) aluminum plate wear plate was primed with 0.1 percent by weight Elvacite 2008 in 90:10 weight ratio of isopropyl alcohol and water using a #3 Mayer rod and thereafter air dried in a hood. 10.0 grams of a 10 percent by weight solution of polyamide (Elvamide 8061, available form E.I. du Pont de Nemours & Co.) in 80:20 weight ratio solvent of methanol and propanol and 1.0 gram of N,N'-diphenyl-N,N'-bis(3-hydroxyphenyl)-[1,1'-biphenyl]-4,4'-diamine (a dihydroxy arylamine) were roll milled about 2 hours and then allowed to stand several hours before use. This coating solution was applied to the primed plate using a #75 Mayer rod. The applied film was dried under cover in a hood (fan off), for about 30 minutes to I hour. The cover was removed and the sample was oven dried at 70° C. for 1 hour and then at 125° C. for 2 hours. The dried coating thickness was 25.0 micrometers. When subjected to the wear characterization test, the wear data was found to be 8 nanometers of wear/k cycle.

EXAMPLE II

The procedures described in Example I was repeated with the same materials and conditions except that 8.0 grams of a 0.1 percent by weight solution of polyamide (Elvamide 8061, available form E.I. du Pont de Nemours & Co.) in 90:10 weight ratio of methanol and propanol and 0.8 gram of N,N'-diphenyl-N,N'-bis(3-hydroxyphenyl)-[1,1'-biphenyl]-4,4'-diamine (a dihydroxy arylamine) were roll milled about 2 hours and then allowed to stand several hours before use. This coating solution was applied to the primed plate using a #60 Mayer rod. The applied film was dried under cover in a hood (fan off) for about about 1 hour. The cover was removed and the sample was oven dried at 125° C. for 45 minutes. The dried coating thickness was 9.5 micrometers. When subjected to the wear characterization test, the wear data was found to be 6 nanometers of wear/k cycle.

EXAMPLE III

The procedures described in Example I was repeated with the same materials and conditions except that 7.0 grams of a 10 percent by weight solution of polyamide (Elvamide 8064, available form E.I. du Pont de Nemours & Co.) in 90:10 weight ratio of methanol and 1,1,2 trichloroethane and 0.7 gram of N,N'-diphenyl-N,N'-bis(3-hydroxyphenyl)-[1,1'-biphenyl]-4,4'-diamine (a dihydroxy arylamine) were roll milled about 1 hour and then allowed to stand two hours before use. This coating solution was applied to the primed plate using a #75 Mayer rod. The applied film was air dried under cover in an open hood (fan off) for about 30 minutes and then in the hood with the fan on for about 30 minutes. This was followed by one hour of drying in a 50° C. oven followed by 2 hours in an oven at 125° C. The dried coating thickness was 20.5 micrometers. When subjected to the wear characterization test, the wear data was found to be 7 nanometers of wear/k cycle.

EXAMPLE IV

A primed sample plate as described in Example I was prepared. 10 grams of a 10 percent by weight solution of polycarbonate (Makrolon) and 1 gram of N,N'-bis(3-methyl-phenyl)-[1,1'biphenyl]-4,4'-diamine were mixed for about 24 hours. The coating solution was applied to the primed plate using a #50 Mayer rod. The applied film was dried in a forced air oven at 80° C. for 30 minutes. The dried coating thickness was 15 micrometers. When subjected to the wear characterization test, the wear data was found to be 27 nanometers of wear/k cycle.

EXAMPLE V

A photoreceptor sample was prepared by forming coatings using conventional techniques. The sample had a charge generator layer containing photoconductive particles dispersed in a binder and a charge transport layer containing 40 percent by weight N,N'-diphenyl-N,N'-bis(3-methyl-phenyl)-(1,1'biphenyl)-4,4'-diamine in 60 percent by weight polycarbonate polycarbonate resin [poly(4,4'-isopropylidene-diphenylene carbonate, available as MakroIon R from Farbenfabricken Bayer A. G.]. The N,N'-diphenyl-N,N'-bis(3-methyl-phenyl)-(1,1'biphenyl)-4,4'-diamine is an electrically active aromatic diamine charge transport small molecule whereas the polycarbonate resin is an electrically inactive film forming binder. Half of the length of the sample was coated with an overcoat of 50 percent by weight polyamide (Elvamide 8061, available from dupont de Nemours & Co.), 45 percent by weight N,N'-diphenyl-N,N'-bis(3-hydroxyphenyl)-[1,1'-biphenyl]-4,4'-diamine (a dihydroxy arylamine), 5 percent by weight triphenyl methane (formula illustrated in FIG. 14) dissolved in 1:1 methanol/n-propanol to form a 20 percent by weight solids solution. The coated sample was dried in a forced air oven to form an overcoat layer. Electrical tests for PIDC characteristics were conducted in regions with and without overcoat. The residual on the overcoat side was equivalent to that measured in the non-overcoated side even after many cycles. The print quality was equivalent.

EXAMPLE VI

To determine whether the half coated with the overcoat of this invention would create problems in high RH atmosphere, print testing was carried out after conditioning the drum in 27° C. (80° F.), 80 percent RH atmosphere. The print quality was equivalent to that obtained on the uncoated half.

EXAMPLE VII

Wear testing was carried out on a sample coated with charge transport transport layer containing 40 percent by weight N,N'-diphenyl-N,N'-bis(3-methylphenyl)-(1,1'-biphenyl)-4,4'-diamine and 60 percent by weight polycarbonate. Half of the charge transport layer on the sample had no overcoat and the other half was coated with an overcoat of 50 percent by weight polyamide (Elvamide 8061, available from Du Pont de Nemours & Co.), 45 percent by weight N,N'-diphenyl-N,N'-bis(3-hydroxyphenyl)-[1,1'-biphenyl]-4,4'-diamine (a dihydroxy arylamine), 5 percent by weight triphenyl methane (:formula illustrated in FIG. 14) dissolved in 1:1 methanol/n-propanol. After coating and drying, the wear rate was determined using the test above. It was found that wear in the overcoated region was reduced by a factor of 3–4 as compared to the region not overcoated.

EXAMPLE VIII

Corona induced deletion characteristic tests were conducted for a drum identical to that described in Example VII. This test is described above in the introduction to the working examples. Dramatic improvements were observed with the overcoated side.

EXAMPLE IX

Liquid ink compatibility of a drum identical to that described in Example VII was tested by soaking the drum in Isopar. Molecules of N,N'-diphenyl-N,N'-bis(3-methylphenyl)-(1,1'-biphenyl)-4,4'-diamine started leaching out within minutes in the region without the overcoat whereas the side with the overcoat remained stable even after days of soaking.

EXAMPLE X

An organic photoreceptor drum containing a charge generating layer of photoconductive particles dispersed in a binder and a charge transport layer containing N,N'-diphenyl-N,N'-bis(3-methylphenyl)-(1,1'-biphenyl)-4,4'-diamine in polycarbonate was overcoated over one half of its surface with an overcoating containing 50 percent by weight N,N'-diphenyl-N,N'-bis(3-hydroxyphenyl)-[1,1'-biphenyl]-4,4'-diamine and 50 percent by weight polyamide (Elvamide 8061) having a final dry film thickness of 3.0 micrometers. Extensive print testing to several thousand continuous copies showed evidence of fine line deletion only on the overcoated portion of the drum surface.

EXAMPLE XI

An organic photoreceptor drum containing a charge generating layer of photoconductive particles dispersed in a binder and a charge transport layer containing N,N'-diphenyl-N,N'-bis(3-methylphenyl)-(1,1'-biphenyl)-4,4'-diamine in polycarbonate was overcoated over one half of its surface with an overcoating containing 40 percent by weight N,N'-diphenyl-N,N'-bis(3-hydroxyphenyl)-[1,1'-biphenyl]-4,4'-diamine, 10 percent by weight dihydroxy triphenyl methane and 50 percent by weight polyamide (Elvamide 8061) having a final dry film thickness of 3.0 micrometers. Extensive print testing to several thousand continuous copies showed no deletion on the overcoated portion of the drum identical to the non-overcoated control area.

Although the invention has been described with reference to specific preferred embodiments, it is not intended to be limited thereto, rather those skilled in the art will recognize that variations and modifications may be made therein which are within the spirit of the invention and within the scope of the claims.

What is claimed is:

1. An electrophotographic imaging member comprising a substrate, a charge generating layer, a charge transport layer, and an overcoat layer comprising a hole transporting hydroxy arylamine compound having at least two hydroxy functional groups, a hydroxy triphenyl methane compound having at least one hydroxy functional group and a polyamide film forming binder capable of forming hydrogen bonds with said hydroxy functional groups of said hydroxy arylamine compound and said hydroxy triphenyl methane compound.

2. An electrophotographic imaging member according to claim 1 wherein said hole transporting hydroxy arylamine compound is represented by the formula:

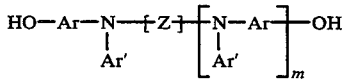

wherein:

m is0or 1,

Z is selected from the group consisting of:

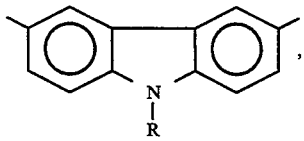

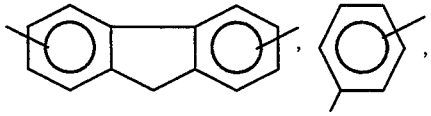

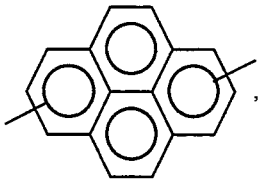

and

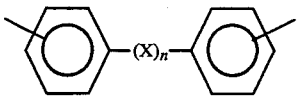

n is 0 or 1,

Ar is selected from the group consisting of:

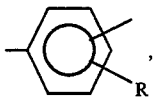

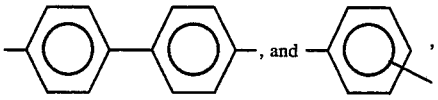

R is selected from the group consisting of $-CH_3$, $-C_2H_5$, $-C_3H_7$, and $-C_4H_9$, Ar' is selected from the group consisting of:

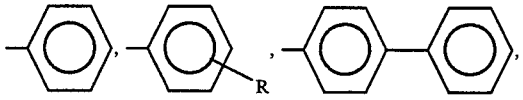

and

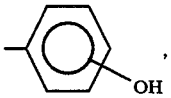

X is selected from the group consisting of:

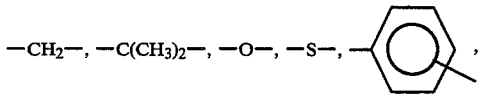

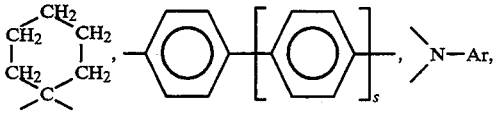

and

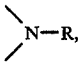

and s is0, 1 or2, said hydroxy arylamine compound being free of any direct conjugation between the —OH groups and the nearest nitrogen atom through one or more aromatic rings.

3. An electrophotographic imaging member according to claim 1 wherein said hole transporting triphenyl methane compound compound is represented by the formula:

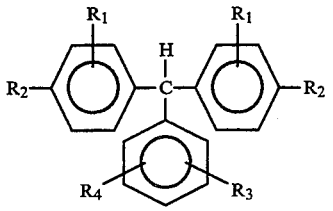

wherein $R_1$, $R_2$, $R_3$, and $R_1$, are independently selected from the group consisting of:

$-CH_3$, $-H$, $-OH$, $-N(CH_2CH_3)$,s

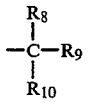

wherein $R_8$, $R_9$ and $R_{10}$ are independently selected from H, $-(CH_2-)n'''CH_3$ wherein n''' is an integer from 0 to 6,

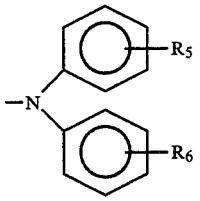

wherein $R_5$ and $R_6$ are independently selected form the group consisting of H, $-(CH_2)_{n''''}CH_3$ wherein n''''is an integer from 0 to 6,

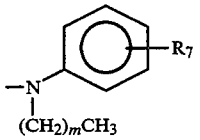

wherein $R_7$ is independently selected from H, $-(CH_2)_{n'''''}CH_3$ wherein n'''''and m are an integer from 0 to 6, $-N(CH_3)CH_2CH_2OH$, $-N(CH_2)_nCH_3(CH_2)_{n'}OH$ wherein n is an integer from 0 to 6 and n' is an integer from 1 to 6, $-N[(CH_2)n''\ CH_2OH]_2$ wherein n'' is an integer from 0 to 6, wherein at least one or more of $R_1$, $R_2$, $R_3$, or $R_4$ must contain at least one hydroxy group, and wherein at least one or more of $R_1$, $R_2$, $R_3$, or $R_4$ must contain at least one amino group.

4. An electrophotographic imaging member according to claim 1 wherein said polyamide film forming binder contains —CONH groups capable of forming hydrogen bonds with said hydroxy functional groups of said hydroxy arylamine compound and said hydroxy triphenyl methane compound.

5. An electrophotographic imaging member according to claim 1 wherein the concentration of said hydroxy arylamine compound in said overcoat layer is between about 20 percent and about 50 percent by weight based on the total weight of said overcoat after drying.

6. An electrophotographic imaging member according to claim 1 wherein the concentration of said hydroxy triphenyl methane molecule in said overcoat layer is between about 0.5 percent and about 50 percent by weight based on the total weight of said overcoat after drying.

7. An electrophotographic imaging member according to claim 1 wherein the concentration of said polyamide in said overcoat layer is between about 50 percent and about 95 percent by weight based on the total weight of said overcoat after drying.

8. An electrophotographic imaging member according to claim 1 wherein said hydroxy triphenyl methane molecule is N,N'-diphenyl-N,N'-bis(3-hydroxyphenyl)-[1,1'-biphenyl]-4,4'-diamine.

9. An electrophotographic imaging member according to claim 1 wherein said hydroxy triphenyl methane molecule is N,N,N',N',-tetra(3-hydroxyphenyl)-[1,1'-biphenyl]-4,4'-diamine.

10. An electrophotographic imaging member according to claim 1 wherein said hydroxy triphenyl methane molecule has the following structure:

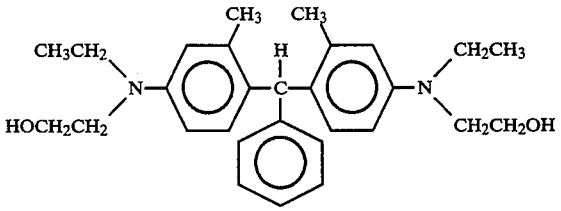

11. An electrophotographic imaging member according to claim 1 wherein said charge transport layer is between said substrate and said charge generation layer.

12. An electrophotographic imaging member according to claim 11 wherein said charge transport layer comprises electrically active charge transporting molecules dissolved or molecularly dispersed in an electrically inactive polymer binder which is insoluble in alcohol.

13. An electrophotographic imaging member according to claim 1 wherein said charge transport layer is substantially free of triphenyl methane molecules.

14. An electrophotographic imaging member according to claim 1 wherein said charge generation layer is between said substrate and said charge transport layer.

15. An electrophotographic imaging member according to claim 1 wherein said overcoat layer is a continuous layer having a thickness up to about about 10 micrometers.

16. An electrophotographic imaging member according to claim 1 wherein said charge transport layer has a thickness of between about 5 micrometers and about 50 micrometers.

* * * * *